US005380353A

United States Patent [19]

Goto et al.

[11] Patent Number: 5,380,353

[45] Date of Patent: * Jan. 10, 1995

[54] COPPER SMELTING APPARATUS

[75] Inventors: Moto Goto; Nobuo Kikumoto; Osamu Iida, all of Tokyo; Hiroaki Ikoma, Osaka; Shigemitsu Fukushima, Tokyo, all of Japan

[73] Assignee: Mitsubishi Materials Corporation, Tokyo, Japan

[ * ] Notice: The portion of the term of this patent subsequent to Apr. 27, 2010 has been disclaimed.

[21] Appl. No.: 40,999

[22] Filed: Mar. 31, 1993

Related U.S. Application Data

[63] Continuation-in-part of Ser. No. 797,116, Nov. 20, 1991, Pat. No. 5,205,859.

[30] Foreign Application Priority Data

| | | | |
|---|---|---|---|
| Nov. 20, 1990 | [JP] | Japan | 2-314671 |
| Nov. 20, 1990 | [JP] | Japan | 2-314673 |
| Nov. 20, 1990 | [JP] | Japan | 2-314675 |
| Nov. 20, 1990 | [JP] | Japan | 2-314682 |

[51] Int. Cl.[6] ..... C22B 15/06

[52] U.S. Cl. ..... 75/640; 75/641; 75/643; 266/162

[58] Field of Search ..... 266/162; 75/643, 640, 75/641

[56] References Cited

U.S. PATENT DOCUMENTS 4,451,291 5/1984 Leiponen ..... 75/643

*Primary Examiner*—Peter D. Rosenberg
*Attorney, Agent, or Firm*—Oblon, Spivak, McClelland, Maier & Neustadt

[57] ABSTRACT

There is disclosed an apparatus for smelting copper which includes a blister copper-producing device. A plurality of anode furnaces are provided for refining the blister copper produced in the blister copper-producing device into copper of higher quality. A blister copper launder assembly, which has a main launder and a plurality of branch launders branched off from the main launder, is provided to connect the converting furnace and the anode furnaces together. A selecting device may be attached to the launder assembly for selectively bringing the main launder into fluid communication with one of the branch launders.

7 Claims, 14 Drawing Sheets

COPPER SMELTING APPARATUS

CROSS-REFERENCE TO RELATED APPLICATION

This is a continuation-in-part of our application Ser. No. 07/797,116 filed Nov. 20, 1991, now U.S. Pat. No. 5,205,859.

BACKGROUND OF THE INVENTION

1. Field of the Invention

The present invention relates to an apparatus for smelting copper sulfide concentrates to extract copper.

2. Prior Art

As schematically depicted in FIGS. 1 and 2, a copper smelting apparatus comprised of a plurality of furnaces is hitherto known. The smelting apparatus comprises a smelting furnace 1 for melting and oxidizing the copper concentrates supplied together with oxygen-enriched air, to produce a mixture of matte M and slag S, a separating furnace 2 for separating the matte M from the slag S, a converter or converting furnace 3 for oxidizing the separated matte M into blister copper C and slag, and anode furnaces 4 and 4 for refining the blister copper C thus obtained to produce copper of higher purity. In each of the smelting-furnace 1 and the converting furnace 3, lances 5 each composed of a double-pipe structure are inserted through the furnace roof and attached thereto for vertical movement. Copper concentrates, oxygen-enriched air, flux and so on are supplied into each furnace through the lance 5. The separating furnace 2 is an electric furnace, which is equipped with electrodes 6.

As shown in FIG. 1, the smelting furnace 1, the separating furnace 2 and the converting furnace 3 are arranged so as to have different elevations in the descending order, and are connected in series through launder 7A and 7B, so that the melt is tapped via gravitational force through these launders 7A and 7B.

Thus, in the conventional copper smelting apparatus shown in FIGS. 1 and 2, the smelting furnace 1, the separation furnace 2 and the converting furnace 3 constitute a facility for producing blister copper C. However, other type of known facilities including reverberatory furnaces, flash furnaces or the like could as well be employed to produce the blister copper.

Since the anode furnaces 4 must be operated in batches to control the final composition of the copper, the blister copper C produced in the blister copper-producing facility is stored temporarily in a holding furnace 8, and then received in a ladle 9, which is conveyed by means of a crane 10 to the anode furnaces 4, and the blister copper C is poured thereinto through the inlet provided in the top wall.

In FIG. 2, the character L denotes an example of locus of the movement of the ladle 9 which conveys the blister copper melt from the holding furnace 8 to the anode furnaces 4. In the anode furnaces 4, the impurities are oxidized and removed from the blister copper C, and copper oxide formed during the oxidation is deoxidized into copper of higher quality. Then, the resulting copper is cast into anode plates and subjected to electrorefining to obtain higher purity.

In the conventional smelting apparatus as described above, the blister copper C produced in the converting furnace 3 must be stored temporarily in the holding furnace 8. Accordingly, the installation of the holding furnace 8 is required. In addition, the ladle, the crane and so on are required in order to transport the blister copper C from the holding furnace 8 to the anode furnaces 4. Furthermore, a large amount of energy has been required to keep the temperature of the blister copper C high enough during these operations. As a result, the expenses for the installation of the facilities as well as the running costs are high, and the opportunities for the reduction in the installed area of the smelting apparatus are limited.

Moreover, when receiving the blister copper melt in the ladle or pouring the melt therefrom, the melt is caused to fall from the elevated position. Hence, great air flow occurs, accompanied by the production of gases containing sulfur dioxide and metal fumes, caused by mechanical impact, abrupt air expansion and so on, thereby adversely affecting the environment. Therefore, the installation of fume and dust collectors which are effective for large areas is required.

SUMMARY OF THE INVENTION

It is therefore a principal object and feature of the present invention to provide a novel copper smelting apparatus which does not require holding furnaces between the converting furnace and the anode furnace, and by which the operation up to the refining step at the anode furnaces can be conducted in a highly effective manner.

Another object and feature of the invention is to provide a copper smelting apparatus which includes an improved anode furnace specifically designed for the smelting system without holding furnaces.

A further object and feature of the invention is to provide a copper smelting apparatus in which a plurality of anode furnaces are optimally arranged so as to substantially reduce the entire area of the installation.

According to a principal aspect of the invention, there is provided an apparatus for copper smelting, comprising means for producing blister copper; a plurality of anode furnaces for refining the blister copper produced in the blister copper-producing means into copper of higher quality; and a blister copper launder means for connecting the blister copper-producing means and the anode furnaces.

The blister copper launder means may include a main launder having one end connected to the blister copper-producing means and a plurality of branch launders each having one end connected to the other end of the main launder and the other end connected to a respective one of the anode furnaces. A selecting device may be attached to the blister copper launder means for selectively bringing the main launder into operative fluid communication with one of the branch launders.

According to another aspect of the invention, the above copper smelting apparatus is characterized in that, in each of the anode furnaces, the shell portion is provided with an elongated opening extending circumferentially thereof, and that the blister copper launder means includes an end portion disposed at the opening of the furnace body of the anode furnace.

According to a further aspect of the invention, a plurality of anode furnaces are disposed parallel to one another with one end of each anode furnace being directed toward the converting furnace while the shell portions of adjacent anode furnaces are opposed to each other.

DESCRIPTION OF PREFERRED EMBODIMENTS OF THE INVENTION

Figure 1:
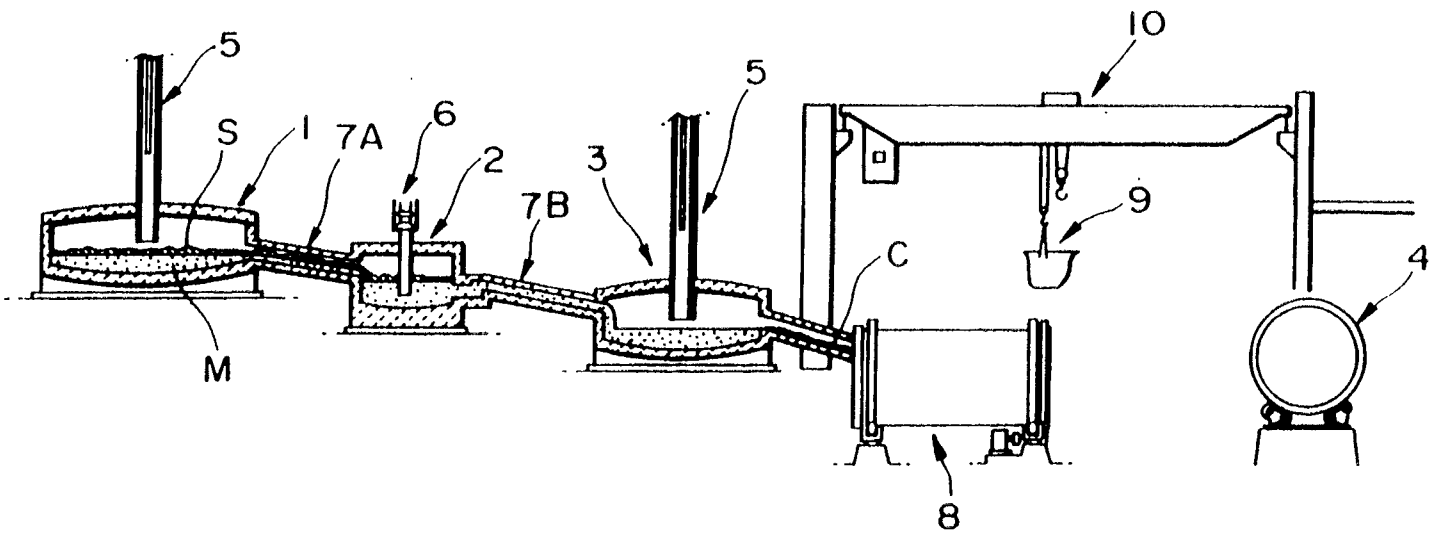
FIG. 1 (PRIOR ART)
FIG. 1 is a schematic cross-sectional view of a conventional copper smelting apparatus.
Figure 2:
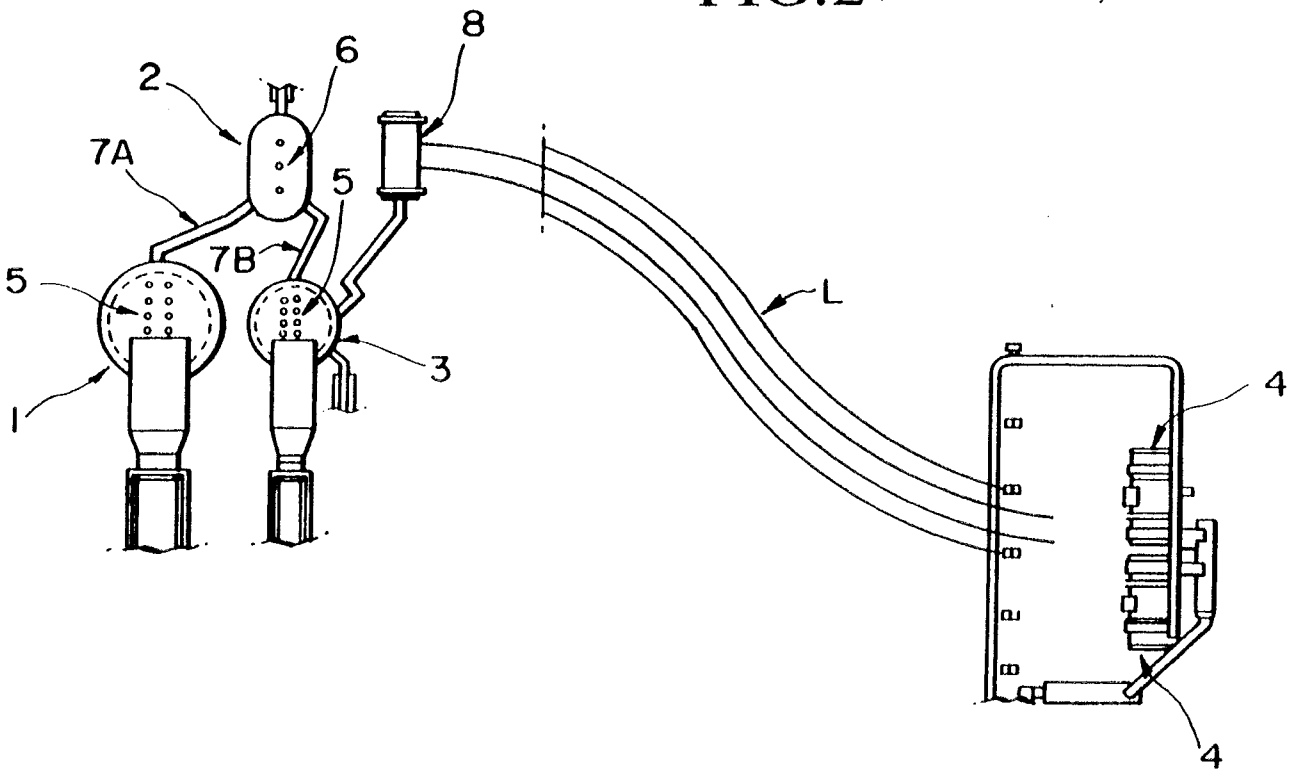
FIG. 2 (PRIOR ART)
FIG. 2 is a schematic plan view of the apparatus of FIG. 1.
Figure 3:
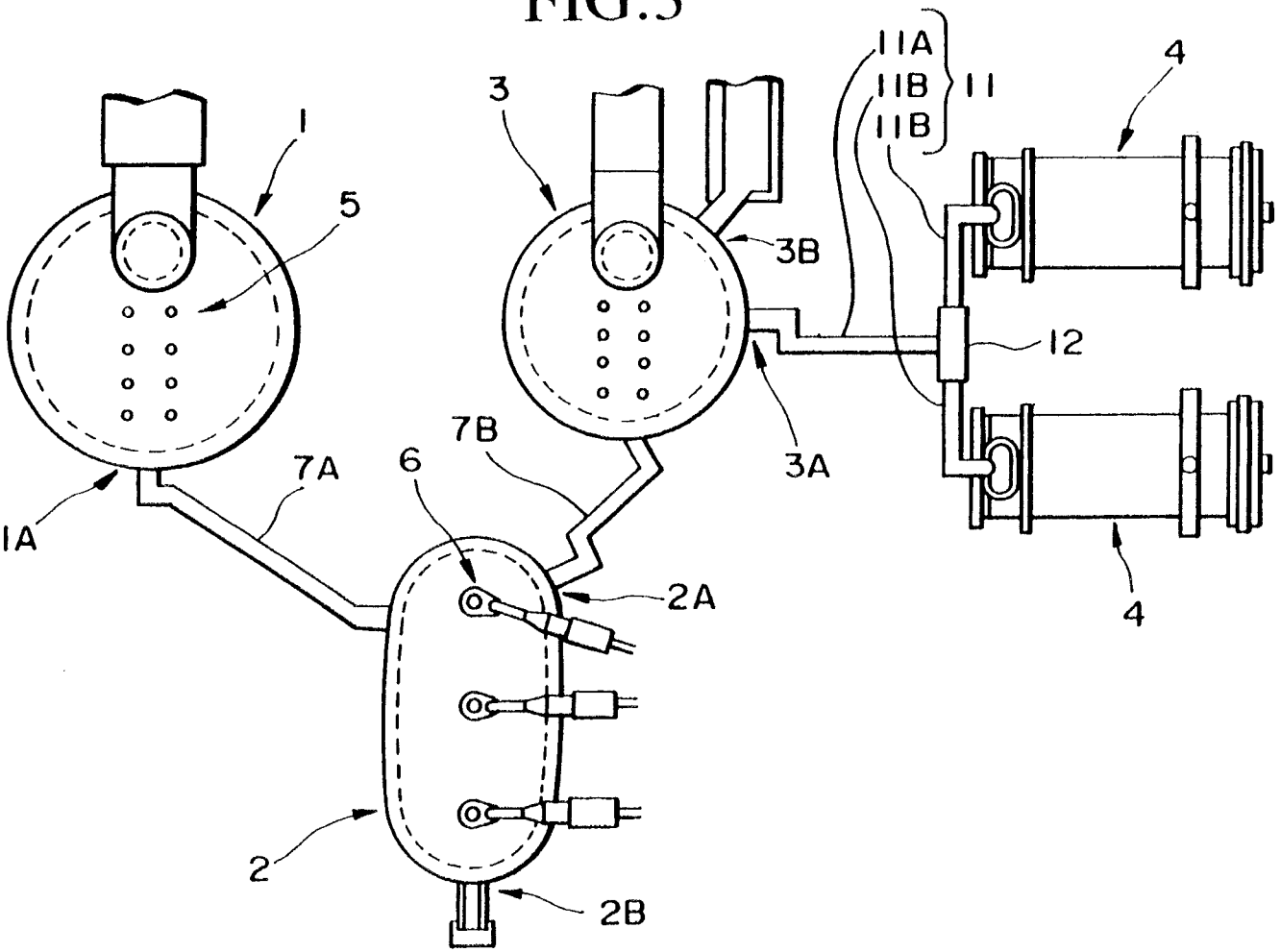
FIG. 3 is a plan view of a continuous copper smelting apparatus in accordance with the present invention.

FIG. 3 depicts a continuous copper smelting apparatus in accordance with an embodiment of the invention, in which the same characters or numerals are used to denote the same parts or members as in FIGS. 1 and 2.

As is the case with the prior art smelting apparatus, the copper smelting apparatus in accordance with the present embodiment comprises a blister copper-producing means or device which includes a smelting furnace 1 for melting and oxidizing copper concentrates to produce a mixture of matte M and slag S, a separating furnace 2 for separating the matte M from the slag S, and a converting furnace 3 for oxidizing the matte M to produce blister copper. The apparatus further includes a plurality of anode furnaces 4 for refining the blister copper produced in the blister copper-producing means into copper of higher purity. The smelting furnace 1, the separating furnace 2 and the converting furnace 3 are arranged so as to have different elevations in the descending order, and a melt transferring means or assembly comprised of inclined launders 7A and 7B defining fluid passageways for the melt, is provided so as to connect the above three furnaces in series. Thus, the melt is tapped from the smelting furnace 1 through the launder 7A to the separating furnace 2, and from the separating furnace 2 through the launder 7B, down into the converting furnace 3. Furthermore, in the smelting furnace 1 and the converting furnace 3, a plurality of lances 5, each composed of a double-pipe structure, are inserted through the furnace roof and secured thereto for vertical movement, and the copper concentrates, oxygen-enriched air, flux and so on are supplied into each furnace through these lances 5. Furthermore, the separating furnace 2 is composed of an electric furnace equipped with a plurality of electrodes 6.

In the illustrated embodiment, two anode furnaces 4 are arranged in parallel with each other and the converting furnace 3 is connected to these anode furnaces 4 through a launder means or assembly 11 defining fluid passageways for blister copper melt. The blister copper launder means 11, through which the blister copper produced in the converting furnace 3 is transferred to the anode furnaces 4, includes an upstream main launder 11A connected at its one end to the outlet of the converting furnace 3 and sloping downwardly in a direction away from the converting furnace 3, and a pair of downstream branch launders 11B and 11B branched off from the main launder 11A so as to incline downwardly in a direction away from the main launder 11A and connected at their ends to the anode furnaces 4 and 4, respectively.

Furthermore, means 12 for selectively bringing the main launder 11A into fluid communication with one of the branch launders 11B is provided at the junction between the main launder 11A and the branch launders 11B. This means 12 may be of any structure. In the simplest form, that portion of each branch launder 11B adjacent to the junction with the main launder 11A may be formed such that its bottom is somewhat shallow, and a castable or a lump of refractory material may be cast into the shallow portion of the branch launder 11B which is not to be utilized.

Figure 13:
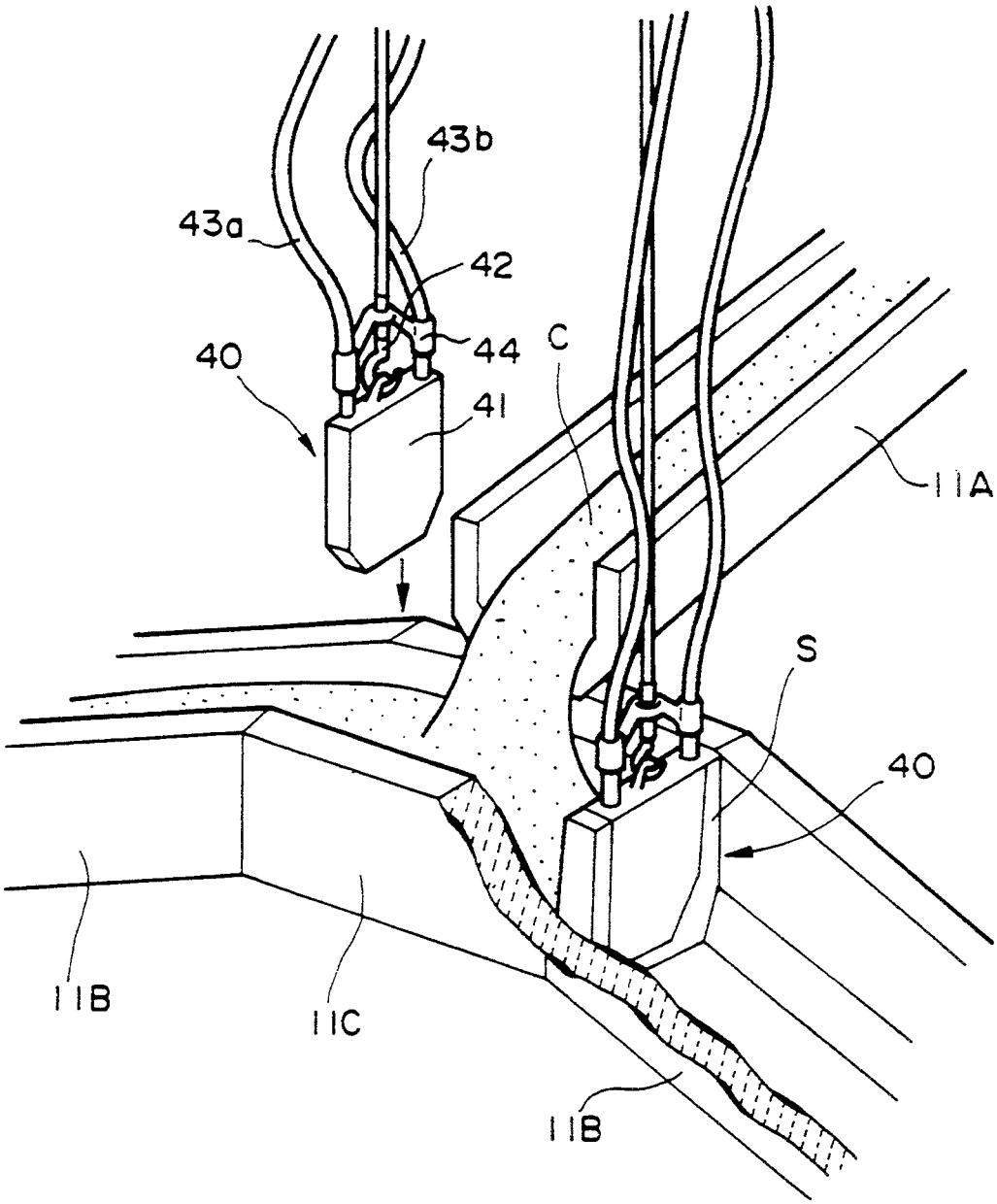
FIG. 13 is a partially cut-away perspective view of a selecting device which may be used with the apparatus of FIG. 3.
Figure 14:
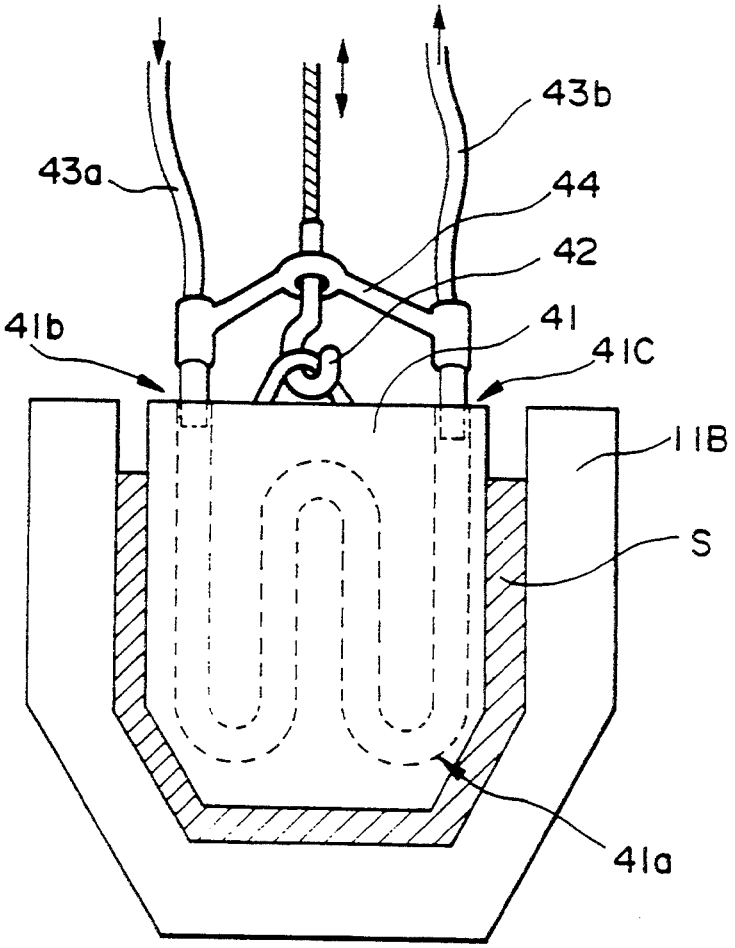
FIG. 14 is a cross-sectional view showing a part of the selecting device of FIG. 13.

Instead of the means of the above structure, the change of the blister copper passageway may be carried out by a suitable selecting device attached to the blister copper launder means 11. FIGS. 13 and 14 depict an example of such a selecting assembly. In this illustrated example, the inclined main launder 11A has an open downstream end, and a pair of branch launders 11B are joined to each other by a horizontal portion 11C, above which the downstream end of the main launder 11A is located. The selecting assembly comprises a pair of closing devices 40 disposed at the upstream ends of the branch launders 11B, respectively. Each of the closing devices 40 includes a closing plate 41 made of the same material as the melt and disposed vertically so as to close the fluid passageway in the branch launder 11B, a lifting device (not shown) connected to the closing plate 41 at its upper end through a hook 42 and a rope, a supply tube **43*a* connected to the closing plate 41 for supplying a coolant into the closing plate 41, and a discharge tube 43*b* connected to the closing plate 41 for discharging the coolant from the closing plate 41. As best shown in FIG. 14, the closing plate 41, which is similar in configuration to the cross-section of the branch launder passageway, is slightly smaller than the cross-section of the branch launder 11B, and is provided with a fluid passageway 41*a* formed meanderingly therethrough and having opposite ends 41*b* and 41*c* opening to the top of the closing plate 41. The supply and discharge tubes 43*a* and 43*b* are sealably and releasably connected to the opening ends 41*b* and 41*c*, respectively, and are supported by the hook 42 through a connecting member 44. The coolant is introduced from the supply tube 43*a* into the fluid passageway 41*a* when closing the branch launder 11B by using the closing device 40 described above. Then, the lifting device is activated to cause the closing plate 41 to move down to close the blister copper passageway of the branch launder 11B. In this situation, although there is a slight gap formed between the closing plate 41 and the branch launder 11B, the melt flowing through the gap is quickly solidified when brought into contact with the closing plate 41, and the solidified blister copper plugs up the gap at S, so that the branch launder passageway is completely closed. Furthermore, when opening the branch launder 11B, the supply of the coolant to the closing plate 41 is first ceased, and then the supply and discharge tubes 43***a* and 43*b* are released from the closing plate 41. When the supply and discharge tubes 43*a* and 43*b* are released, the solidified blister copper S which is plugged up in the gap is melted due to the heat transferred by the melt and caused to flow down through the branch launder 11B. Thus, the closing plate 41 is lifted up by the lifting device.

Furthermore, in addition to the other launders 7A and 7B, the above blister copper launders 11A and 11B are all provided with covers, heat conserving devices such as burners and/or facilities for regulating the ambient atmosphere are provided thereon, whereby the melt flowing down through these launders is kept at high temperature in a hermetically sealed state.

Figure 4:
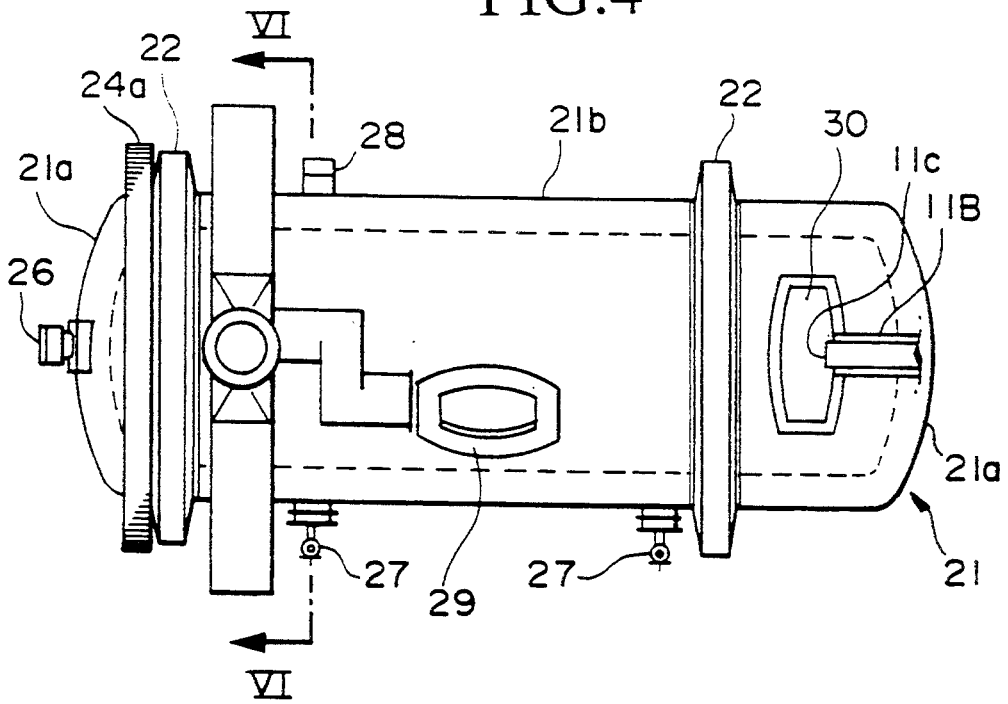
FIG. 4 is an enlarged plan view of an anode furnace used in the apparatus of FIG. 3.
Figure 5:
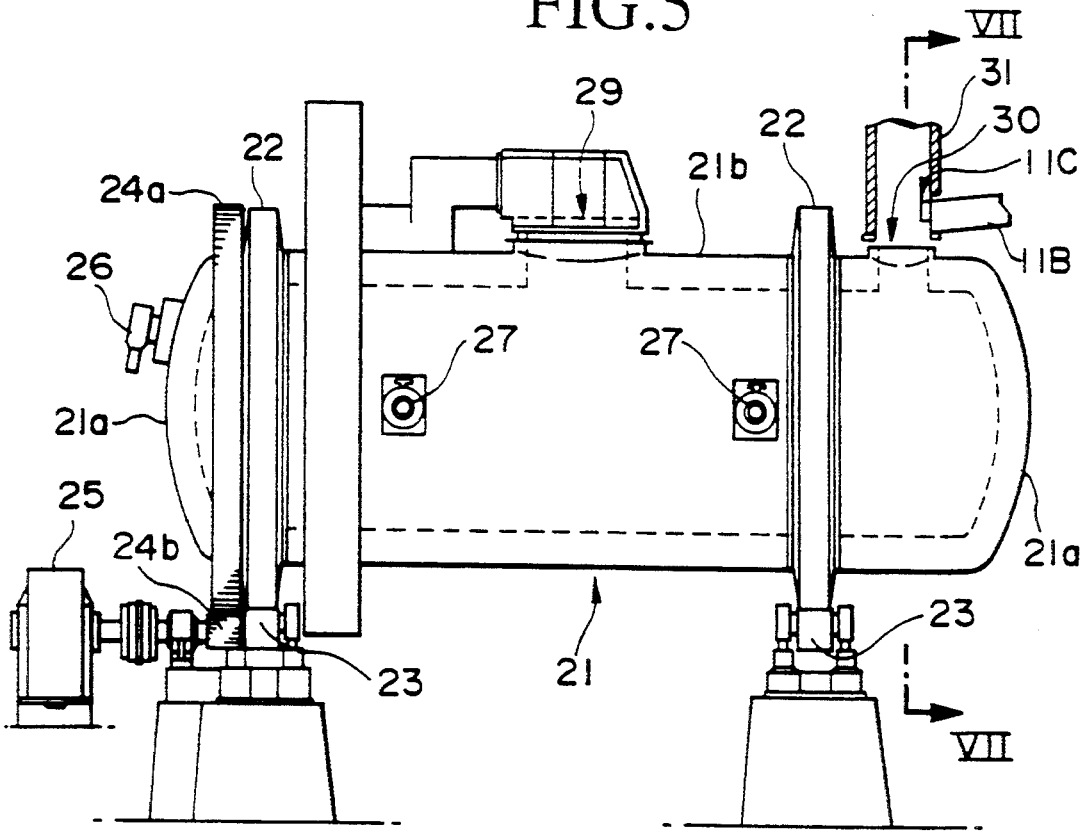
FIG. 5 is an enlarged side-elevational view of the anode furnace of FIG. 4.
Figure 6:
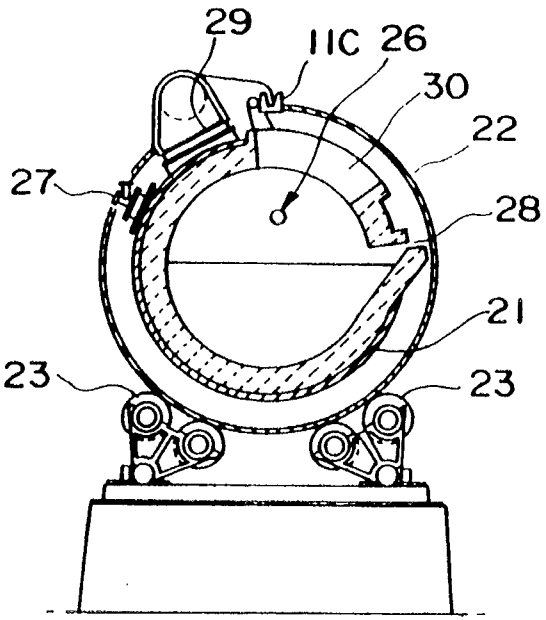
FIG. 6 is a cross-sectional view of the anode furnace of FIG. 4 taken along the line VI—VI in FIG. 4.

As best shown in FIGS. 4 to 6, each anode furnace 4 includes a cylindrical furnace body 21 having a shell portion 21*b* and a pair of end plates 21*a* mounted on the opposite ends of the shell portion 21*b*, which is provided with a pair of tires 22 and 22 fixedly mounted thereon. A plurality of supporting wheels 23 are mounted on a base so as to receive the tires 22, so that the furnace body 21 is supported in a rotatable manner about its axis, which is disposed horizontally. A girth gear 24*a* is mounted on one end of the furnace body 21, and is meshed with a drive gear 24*b*, which is connected to a drive assembly 25 disposed adjacent to the furnace body 21, so that the furnace body 21 is adapted to be rotated by the drive assembly 25.

In addition, as shown in FIGS. 4 and 5, a burner 26 for keeping the melt in the furnace at high temperature is mounted on one of the end plates 21*a*, and a pair of tuyeres 27 and 27 are mounted on the shell portion 21*b* for blowing air or oxygen-enriched air into the furnace body 21. Furthermore, the shell portion 21*b* is provided with a tap hole 28 in opposite relation to one of the tuyeres 27, and the copper refined in the anode furnace is discharged through the tap hole 28 into a casting apparatus, where the copper is cast into anode plates. Furthermore, an inlet 29 for introducing lumps such as anode scraps into the furnace is mounted on the shell portion 21*b* at the upper mid-portion. Moreover, as shown in FIG. 6, a flue opening 30 of a generally elliptical shape is formed on top of the shell portion 21*b* opposite to the burner 26. The flue opening 30 extends circumferentially of the shell portion 21*b* from a position which defines the top of the furnace when situated in the ordinary position.

Figure 7:
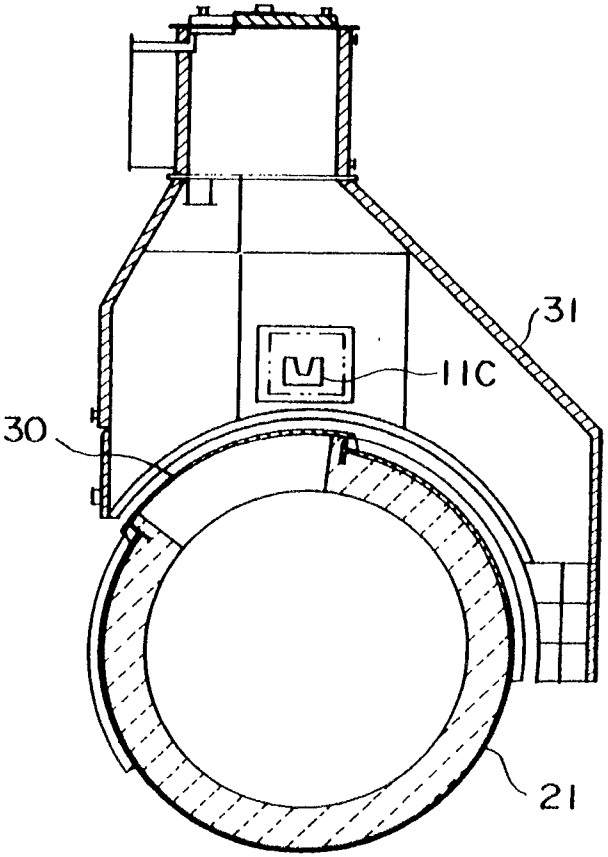
FIG. 7 is a cross-sectional view of the anode furnace of FIG. 4 taken along the line VII—VII in FIG. 5.
Figure 9:
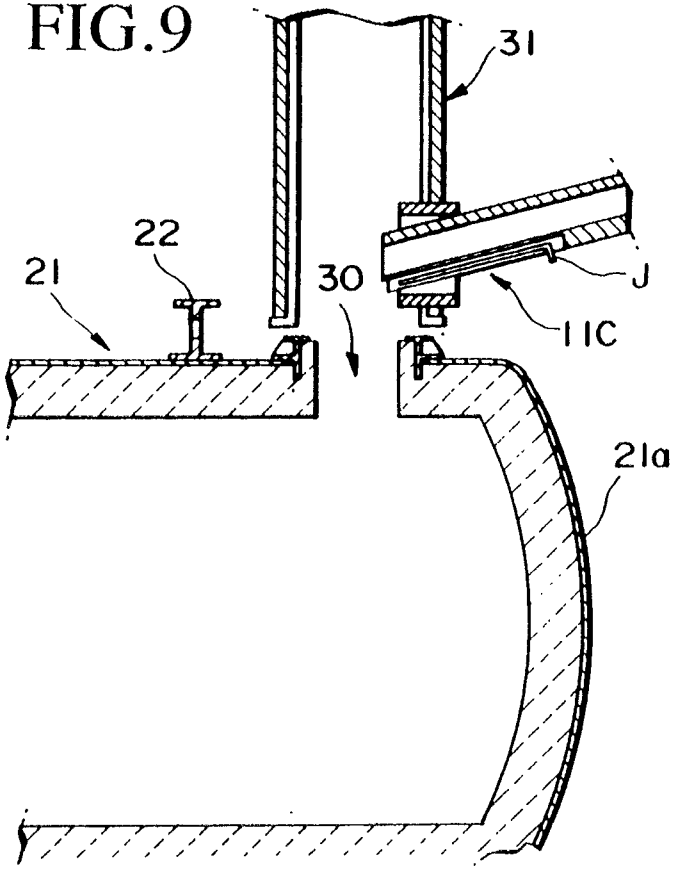
FIG. 9 is a cross-sectional view of the anode furnace taken along the line IX—IX of FIG. 8.
Figure 8:
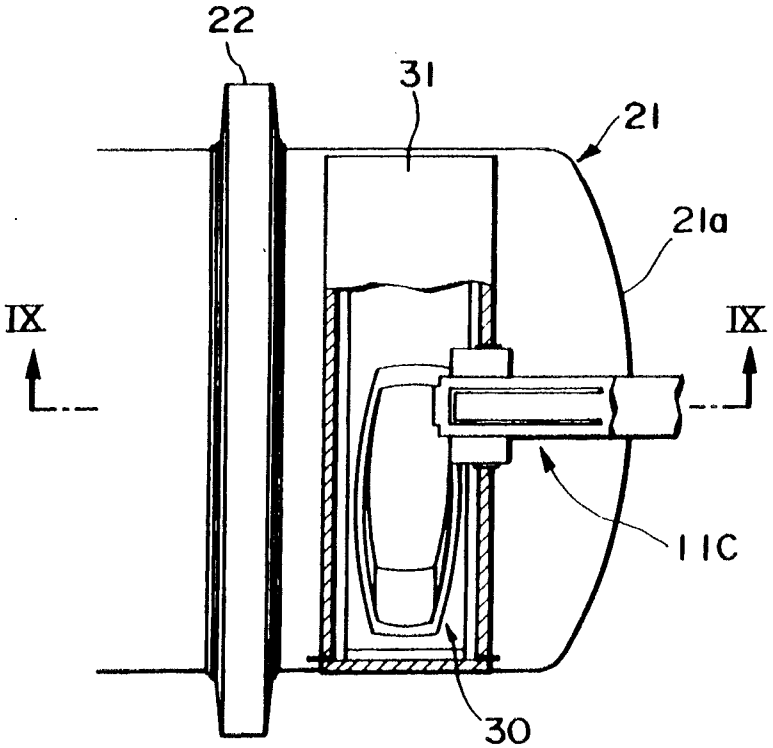
FIG. 8 is a partially cut-away plan view of a part of the anode furnace of FIG. 4.

A hood 31, which is provided at the end of an exhaust duct, is mounted so as to cover this flue opening 30. More specifically, as best shown in FIG. 7, the hood 31 extends so as to cover all of the circumferential zone corresponding to the angular position of the flue opening 30 which moves angularly as the furnace body 21 rotates. Furthermore, as shown in FIG. 9, each branch launder 11B for flowing the blister copper melt is inserted through the side plate of the hood 31 in such a manner that an end 11C of the launder 11B is located above the flue opening 30. The hood 31 as well as the end 11C of the launder 11B are provided with water-cooling jackets J, respectively.

The smelting operations using the aforesaid copper smelting apparatus will now be described.

First, granule materials such as copper concentrates are blown into the smelting furnace 1 through the lances 5 together with the oxygen-enriched air. The copper concentrates thus blown into the furnace 1 are partially oxidized and melted due to the heat generated by the oxidation, so that a mixture of the matte M and the slag S is formed, with the matte containing copper sulfide and iron sulfide as principal constituents and having a high specific gravity, while the slag is composed of gangue mineral, flux, iron oxides and so on, and has a lower specific gravity. The mixture of the matte M and the slag S overflows from the outlet 1A of the smelting furnace 1, through the launder 7A, into the separating furnace 2.

The mixture of the matte M and the slag S which overflowed into the separating furnace 2, is separated into two immiscible layers of matte M and slag S due to the differences in their specific gravity. The matte M thus separated overflows through a siphon 2A provided at the outlet of the separating furnace 2, and is run off into the converting furnace 3 through the launder 7B. The slag S is tapped off from the tap hole 2B, and granulated by water and removed outside the smelting system.

The matte M tapped into the converting furnace 3 is further oxidized by oxygen-enriched air blown through the lances 5, and the slag S is removed therefrom. Thus, the matte M is converted into blister copper C, which has a purity of about 98.5%, and is tapped from the outlet 3A into the blister copper main launder 11A. Furthermore, the slag S separated in the converting furnace 3 has a relatively high copper content. Therefore, after the slag S is discharged from the outlet 3B, it is granulated by water, dried and recycled to the smelting furnace 1, where it is smelted again.

Figure 10:
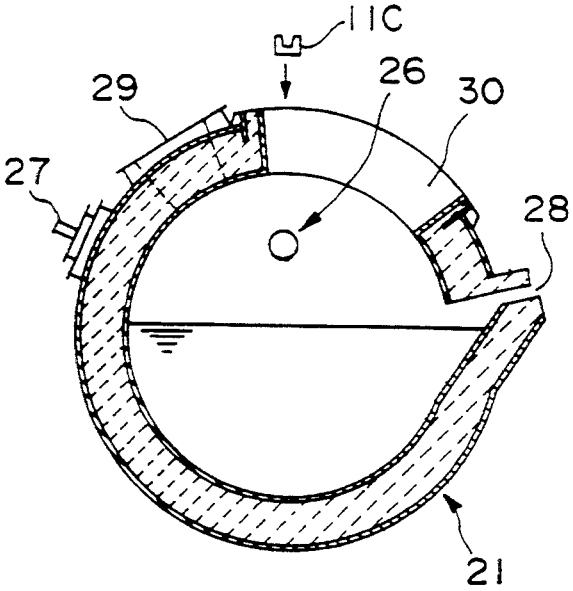
FIGS. 10 to 12 are cross-sectional views of the rotated anode furnace corresponding to blister copper receiving stage, oxidation stage, and reduction stage, respectively.

The blister copper C tapped into the main launder 11A flows through one of the branch launders 11B and 11B, which is brought, in advance, into fluid communication with the main launder 11A by casting a castable into the other branch launder. The blister copper C is then tapped through the flue opening 30 into a corresponding one of the anode furnaces 4. FIG. 10 depicts the rotated position of the anode furnace 4 which is maintained during the receiving operation.

Figure 11:
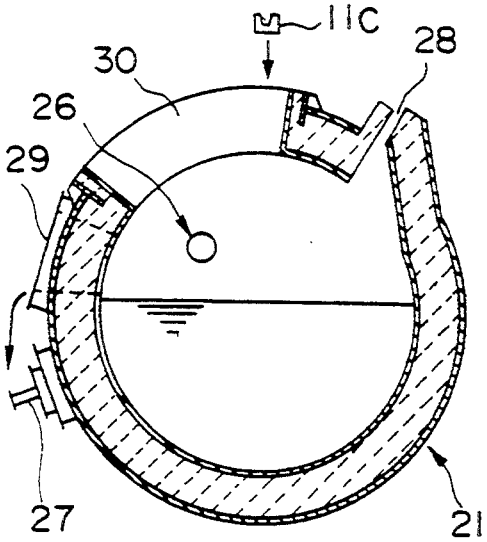

After the receiving operation of the blister copper C is completed, the drive assembly 25 is activated to rotate the furnace body 21 by a prescribed angle to the position as depicted in FIG. 11, where the tuyeres 27 are positioned under the surface of the melt. In this position, air or oxygen-enriched air is first blown through the tuyeres 27 into the furnace body 21 to cause the oxidation of the blister copper C to occur for a prescribed period of time, thereby causing the sulfur concentration in the copper to approach a prescribed target value. Further, a reducing agent containing a mixture of hydrocarbon and air as principal constituents is supplied into the furnace body 21 to carry out the reduction operation, so that the oxygen content in the copper approaches a prescribed target value. The exhausted gas produced during the above operations is recovered by leading the flue gas through the flue opening 30 and the hood 31, into the exhaust gas duct, and suitably treating it. The slag S is discharged from the inlet 29.

Figure 12:
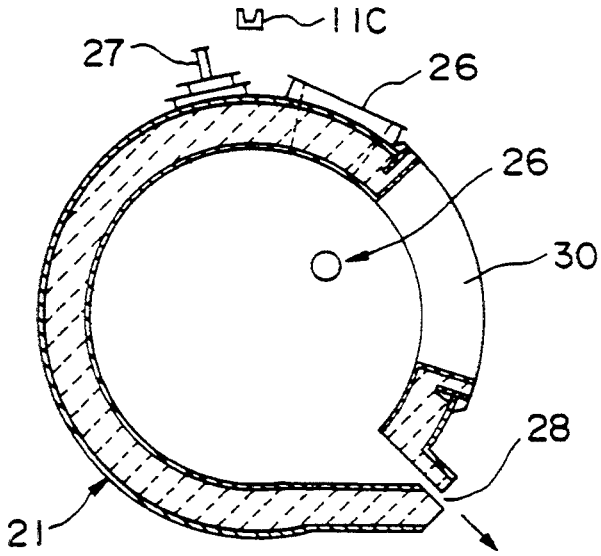

The blister copper C tapped from the converting furnace 4 is thus refined into copper of higher purity in the anode furnace 4. Then, the drive assembly 25 is activated again to further rotate the furnace body 21 by a prescribed angle as shown in FIG. 12, and the molten copper is discharged through the tap hole 28. The molten copper thus obtained is transferred using anode launder to an anode casting mold, and is cast into anode plates, which are then conveyed to the next electro-refining facilities.

As described above, in the copper smelting apparatus of the invention, the transport of the blister copper C from the converting furnace 3 to one of the anode furnaces 4, is carried out directly through the launder means 11 defining fluid passageways for the blister copper melt. Therefore, no holding furnace is required, and consequently the heating operation at the holding furnace is also not required. In addition, inasmuch as no transporting facilities such as ladles, crane and so on are required, the total installation area of the copper smelting apparatus can be substantially reduced. Furthermore, since the facilities such as a holding furnace, ladles, crane and so on are not required, expenses for the installation of these facilities as well as the running costs can be lowered.

Furthermore, since the transport of the blister copper Q from the converting furnace 3 to the anode furnaces 4, is carried out directly by the blister copper launder means 11, it is comparatively easy to maintain the blister copper C in a substantially hermetically sealed state during the transport. Accordingly, a very small amount of the gases containing sulfur dioxide and metal fumes are produced, and the leakage of these gases, which adversely affect the environment, can be prevented in advance. In addition, the temperature variations of the blister copper C can be minimized.

Furthermore, in the aforesaid copper smelting apparatus, the outlet 11*c* of the branch launder 11B, which serves as the fluid passageway for the blister copper melt, is disposed above the flue opening 30 of the anode furnace 4, and this flue opening 30 serves not only as an outlet for the exhaust gas to be discharged from the furnace body 21 but also as an inlet for the blister copper C. In addition, the hood 31, which is connected to the flue duct, is provided so as to cover all the circumferential zone corresponding to the angular position of the flue opening 30 which moves angularly as the furnace body 21 rotates. Accordingly, since the flue opening 30, which is intrinsically indispensable, serves as the inlet for the blister copper melt, and consequently the construction of the apparatus is greatly simplified. Furthermore, since the outlet 11C of each branch launder 11B is heated by the high temperature exhaust gas produced by the combustion of the burner 26, it is not necessary to provide any heat-conserving facilities.

Moreover, since the flue opening 30 is formed so as to extend circumferentially of the shell portion 21*b*, the charging of the melt is possible even when the anode furnace 4 is rotated at a prescribed angle. Therefore, the oxidation can be carried out in parallel with the reception of the blister copper. Furthermore, as compared with the case where the launder is inserted through the end plate 21*a*, the opening area in the furnace body can be reduced. In addition, no interference occurs between the launder 11B and the furnace body 21 even when the furnace body 21 is rotated.

Furthermore, since the end 11C of the launder 11B is provided with the water-cooling jacket J, the strength of the launder is increased by cooling it, so that the durability of the launder is enhanced.

In the illustrated embodiment, two anode furnaces 4 are provided, and the blister copper C produced in the converting furnace 3 is tapped into one of them via the launder selected by the selecting means 12. Consequently, while receiving a new charge of the blister copper C in one of the anode furnaces 4, the blister copper C which has been previously received in the other anode furnace 4 is subjected to oxidation and reduction and cast into anode plates.

Next, typical operational patterns for the steps involving the reception of the blister copper C into the two anode furnaces 4 and 4, the oxidation, the reduction and the casting will be described with reference to the time schedules depicted in FIGS. 15 to 17. The selection of a suitable pattern largely depends on the capacity of the continuous smelting process, i.e. the balancing between the smelting capacity of the smelting furnace and the storage and refining capacities of the anode furnaces.

Figure 15:
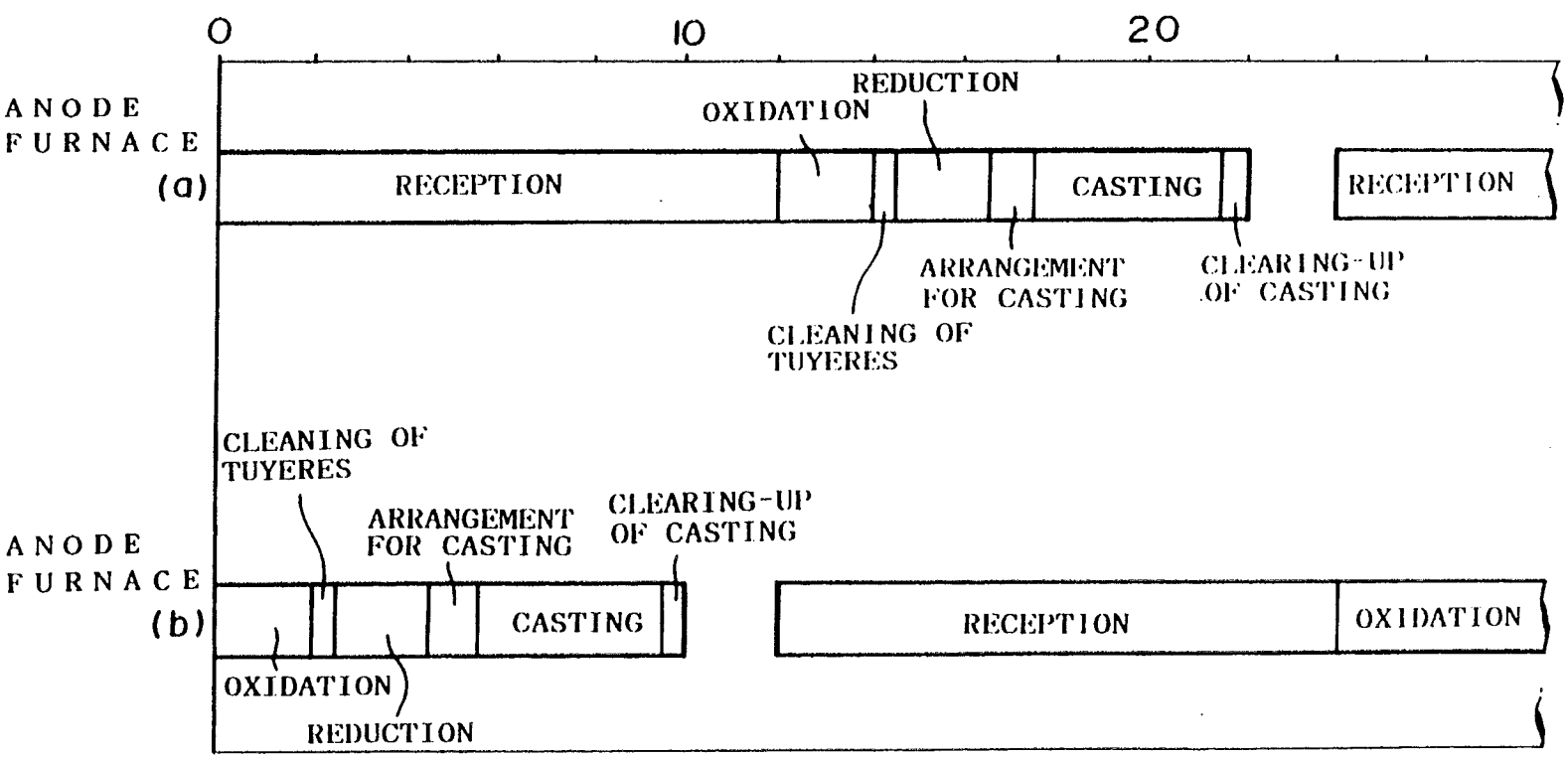
FIGS. 15 to 17 are schematic representations showing the operational flow using the apparatus of FIG. 3.

FIG. 15 corresponds to the case where the capacities of the anode furnaces exceed that of the converting furnace.

While the blister copper C is being received in one of the anode furnaces (a), the blister copper C received in the previous step is subjected to oxidation, reduction, casting and miscellaneous operations accompanying these in the other anode furnace (b). In this pattern, it takes two hours for the oxidation, two hours for the reduction, and four hours for the casting operation. In addition, it takes half an hour to clean the tuyeres between the oxidation operation and the reduction operation, and one hour to arrange for the casting operation between the reduction operation and the casting operation, while it takes half an hour for clearing-up of casting between the casting operation and the commencement of the reception of the next charge. Thus, it takes ten hours from the refining of the received blister copper to the completion of the preparation for the reception of the next blister copper charge.

On the other hand, it takes twelve hours for the receiving operation, and thus the operating time in the anode furnace as described above is shorter than the receiving time. Therefore, sufficient time is available from the completion of the casting operation until the reception of the next charge.

Figure 16:
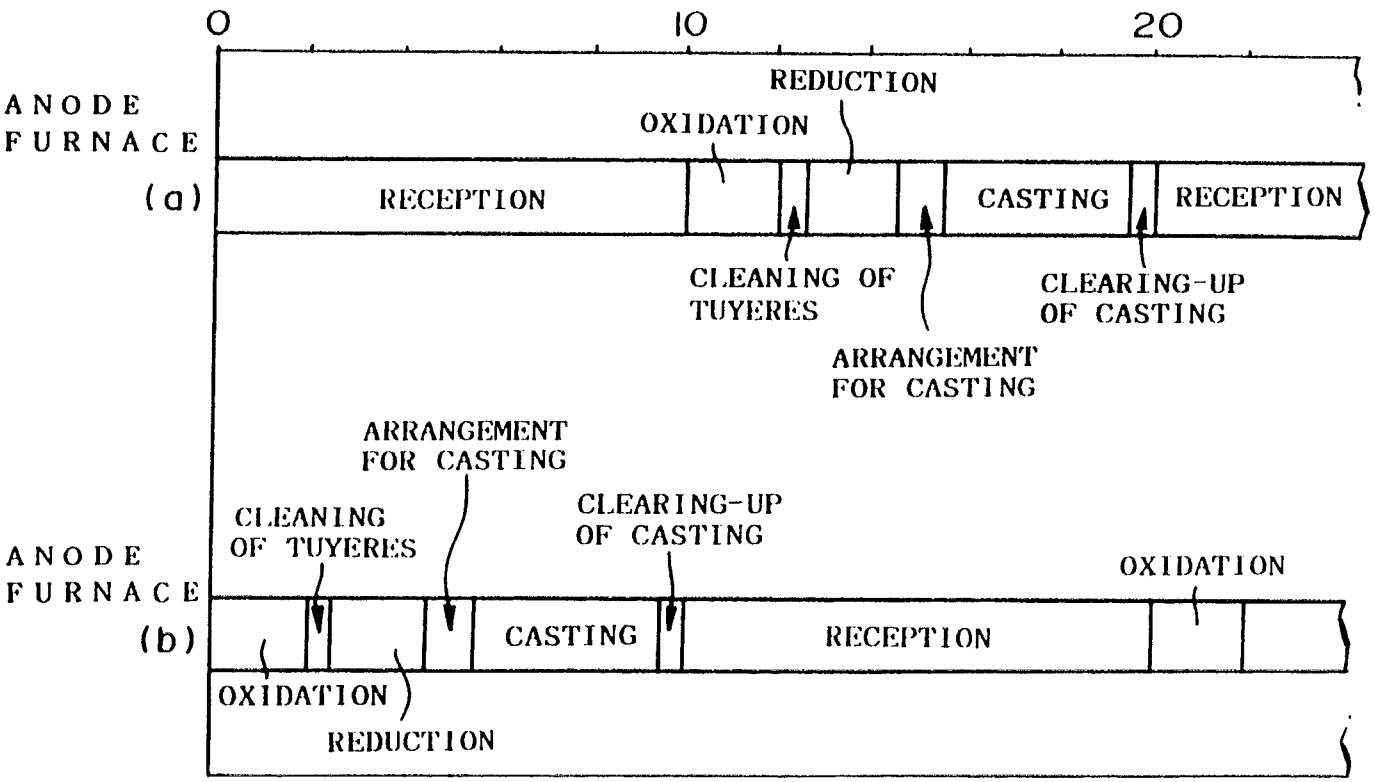

FIG. 16 corresponds to the case where the capacities of the anode furnace and the converting furnace are generally balanced, i.e. the case where the capacities prior to the converting furnace is greater than those in the case of FIG. 15. In this pattern, the total time required for the oxidation, the reduction, the casting operation, and other miscellaneous work such as cleaning of the tuyeres, arrangement for casting or cleaning-up for casting, is ten hours and identical to the aforesaid pattern. However, the time required for receiving the charge into the anode furnace is also ten hours, so that no waiting time is available at the anode furnaces.

Figure 17:
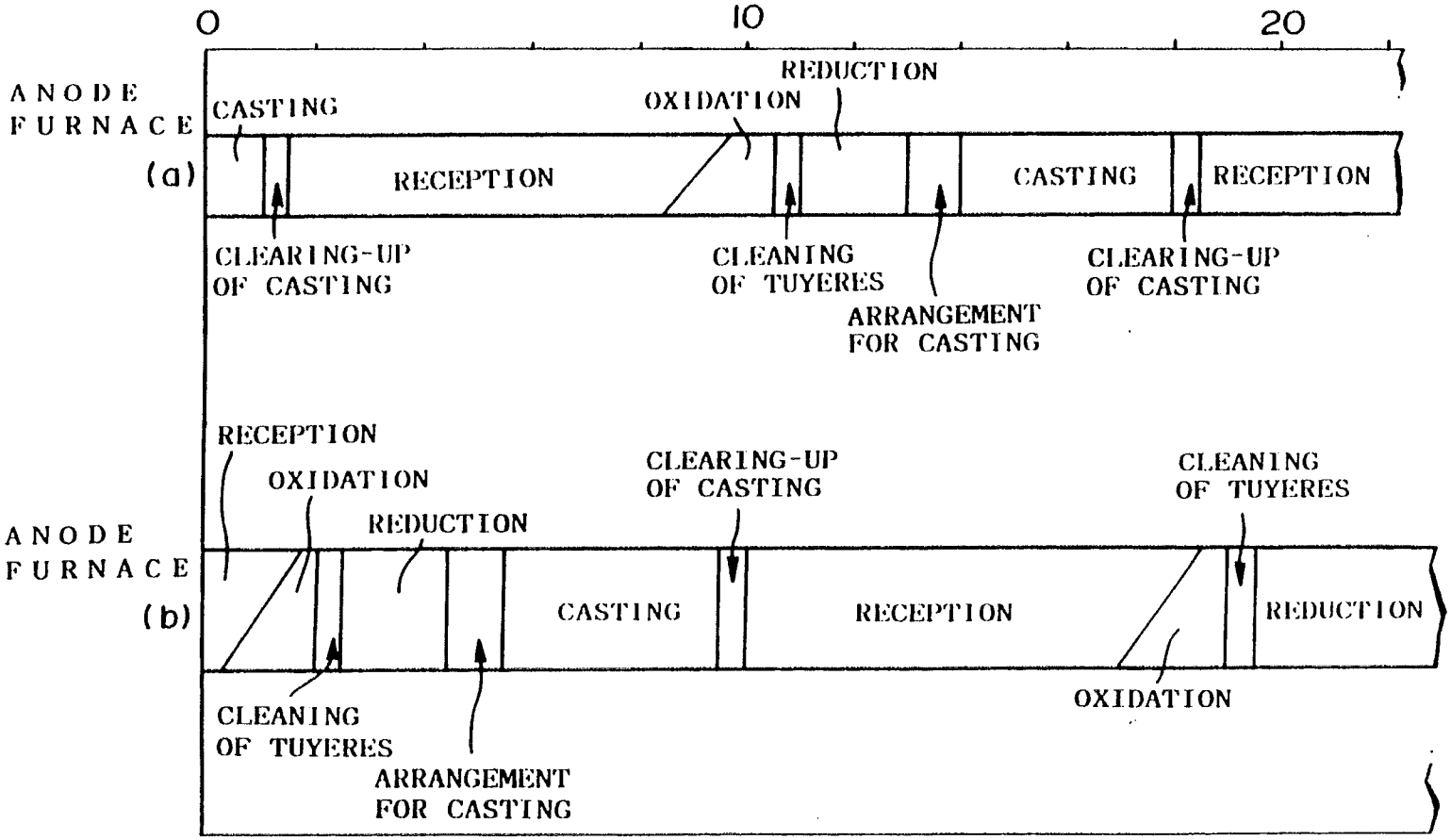

FIG. 17 depicts a pattern which may be adopted when the capacities of the anode furnaces are less than that of the converting furnace. In this case, in order to enhance the refining capacity, the oxidation of the blister copper C is carried out in parallel with the receiving of the blister copper at the last stage of the receiving operation. Specifically, the reception of the blister copper into the anode furnace is completed within 8.5 hours, while it takes 9.5 to 10 hours from the oxidation to the cleaning-up for the casting. Thus, the operation time required for refining is reduced by overlapping the receiving operation and the oxidation operation.

These receiving and oxidizing operations are carried out after the furnace body 21 is moved from the position of FIG. 10 to that of FIG. 11, and is continued even after the reception of the blister copper is completed.

With the above procedures, the reception and the oxidation are carried out in parallel with each other, so that the refining time for the blister copper is reduced by overlapping these processes. Therefore, the capacity of the anode furnace is increased, and when the smelting capacities in the previous steps are increased, the overall production rate is correspondingly enhanced.

In the foregoing, the time schedules shown in FIGS. 15 to 17 are just examples for the operations at the anode furnaces, and other appropriate patterns may be selected depending upon the number, capacities of the anode furnaces, and processing time for the respective operations. Furthermore, as to the overlapping time of the receiving and oxidation operations in FIG. 17, it should be properly determined in consideration of the production rate of the blister copper, oxidation capacity at the anode furnace and so on.

Furthermore, in the aforesaid embodiment, two anode furnaces 4 and 4 are arranged parallel to each other. Accordingly, when another anode furnace is to be installed as a spare, the additional furnace may be simply disposed parallel to the two furnaces with the provision of the additional blister copper branched launder and the selecting means.

The arrangements of the anode furnaces and the blister copper launder means connected thereto will be discussed in detail hereinbelow.

Figure 18:
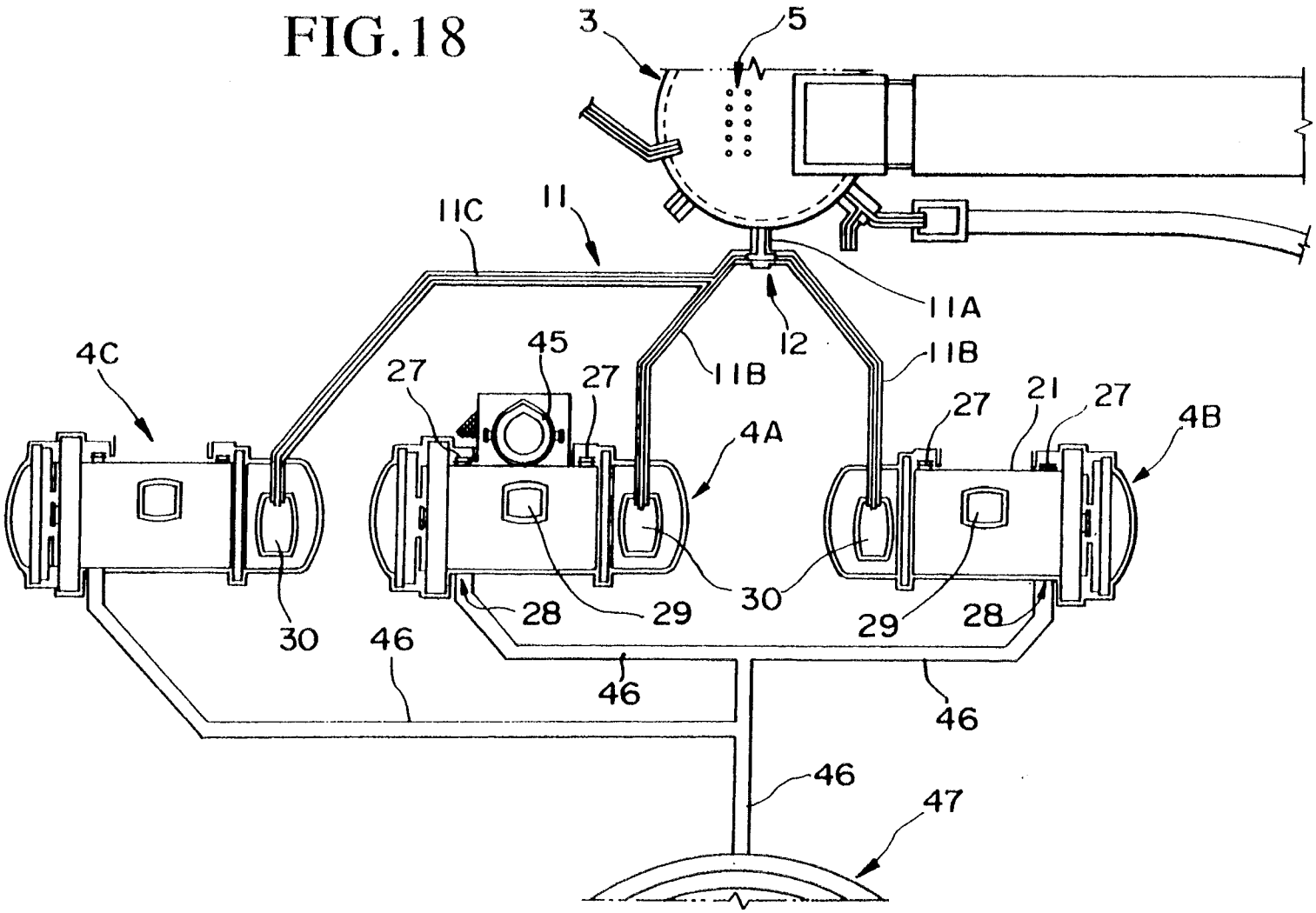
FIG. 18 is a plan view showing an example for the arrangement of the anode furnaces and blister copper launder means for connecting converting furnace to the anode furnaces.

FIG. 18 depicts an example of the arrangements of the anode furnaces, in which two anode furnaces 4A and 4B and one spare anode furnace 4C are arranged in such a manner that their axes are aligned with one another, and the blister copper launder means 11 are arranged so as to connect the converting furnace 3 and each of the anode furnaces 4A to 4C together. Specifically, two anode furnaces 4A and 4B which are regularly operated, are arranged with their flue openings 30 opposed to each other, while the spare anode furnace 4C is arranged with the flue opening 30 adjacent to the two anode furnaces. The blister copper launder means 11 is composed of a main launder 11A connected at one end to the converting furnace 3, and a pair of branch launders 11B each having one end connected to the main launder 11A and the other end connected to the flue opening of a respective one of the anode furnaces 4A and 4B. Furthermore, an additional branch launder 11C which has one end connected to the flue opening of the spare anode furnace 4C, is connected, at the other end, to the upstream portion of the adjacent one of the aforesaid two branch launders 11B. In addition to the selecting means 12 attached to the junction between the main launder 11A and the branch launders 11B, there is provided another selecting means 12A at the junction between the additional launder 11C and the branch launder 11B connected thereto. In the drawings, the numeral 45 denotes a ladle for receiving slag discharged from the inlet of the furnace body 21*a*.

With the above arrangements, however, the distance between the right anode furnace 4B and the left anode furnace 4C is greater than the longitudinal length of the anode furnace. Therefore, the launders for connecting the converting furnace 3 and the anode furnaces become too elongated. In addition, inasmuch as the flue opening 30 and the melt tap hole 28 are positioned in opposite relation to each other with respect to the length of the anode furnace, the distance between the tap holes 28 of the two adjacent anode furnaces also becomes large. Hence, casting launders 46 connecting a casting apparatus 47 and the anode furnaces also become long. Consequently, since the blister copper launders 11 as well as the casting launders 46 are elongated, the smelting apparatus cannot be made compact and the installation area cannot be reduced. Furthermore, when the length of the launder passageways is great, the number of the burners to be attached thereto will be increased, and the structure of the launders will become intricate. Therefore, the running costs as well as the labor required to keep the launders in a hermetically sealed state will be increased.

Figure 19:
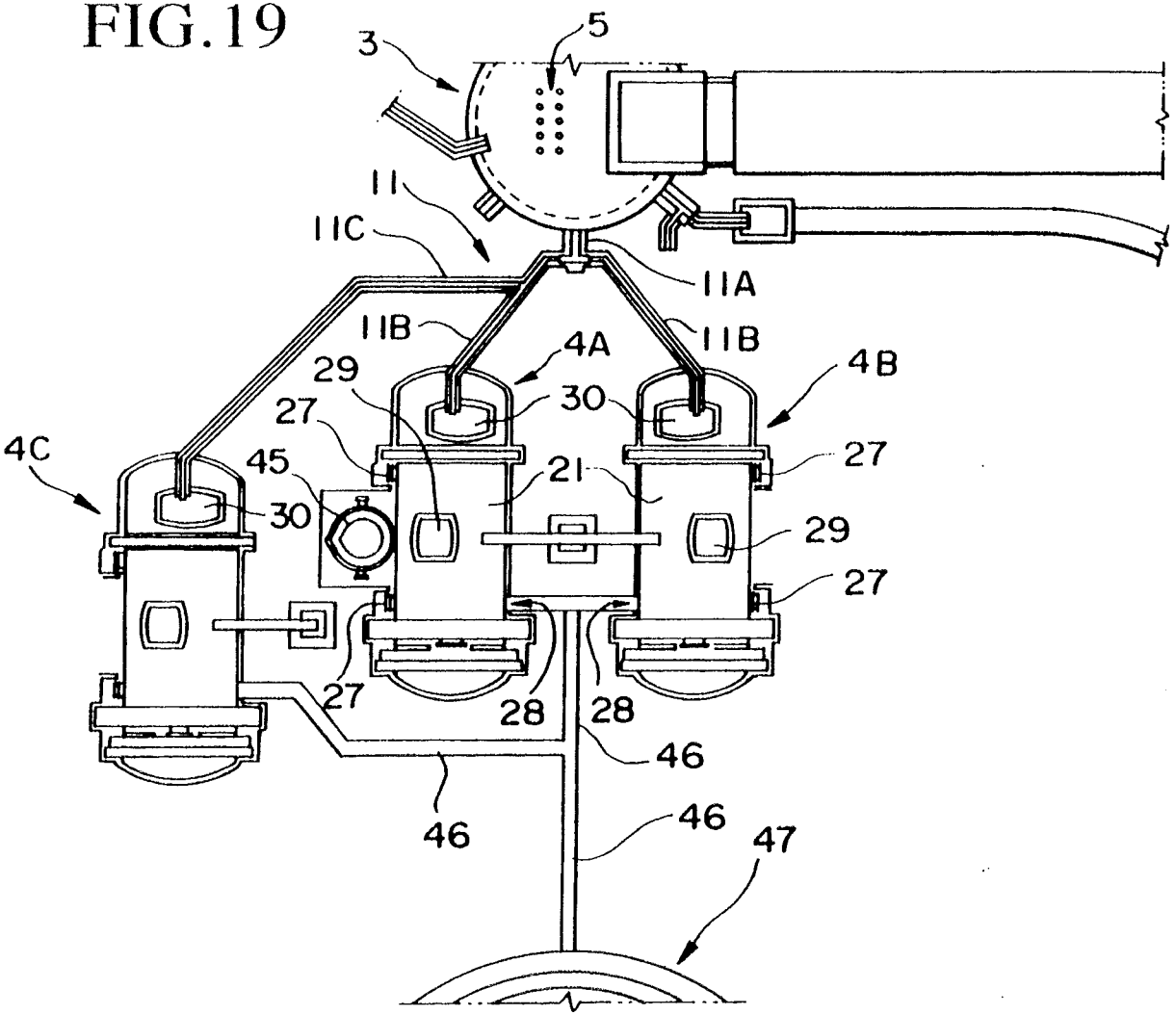
FIG. 19 is a plan view similar to FIG. 18, but showing the preferred arrangement of the anode furnaces and the fluid passageways therefor.

In view of the foregoing, it is preferable that the anode furnaces and the launder means connected thereto are arranged as shown in FIG. 19. In this arrangement, as is the case with the first embodiment, the two anode furnaces 4A and 4B are arranged parallel to each other, and the spare anode furnace 4C is arranged parallel to the two furnaces 4A and 4B, but is somewhat shifted toward the casting apparatus 47. The blister copper launder means 11 is composed of a main launder 11A connected at one end to the converting furnace 3 and a pair of branch launders 11B each having one end connected to the main launder 11A, and the other end connected to the flue opening 30 of a respective one of the anode furnaces 4A and 4B. Furthermore, an additional branch launder 11C which has one end connected to the flue opening 30 of the spare anode furnace 4C, is connected at the other end to the upstream portion of the adjacent one of the aforesaid two branch launders 11B. In addition to the selecting means 12 attached to the junction between the main launder 11A and the branch launders 11B, another selecting means 12A is provided at the junction between the additional launder 11C and the branch launder 11B connected thereto.

With the above arrangements, the spacing between the adjacent anode furnaces is rather small, and hence the distance between the adjacent flue openings is maintained at a minimum. Accordingly, the length of the blister copper launders connected to the flue openings is substantially reduced. In addition, since the tap holes 28 of the adjacent anode furnaces 4A and 4B can be arranged in opposed relation to each other, the casting launders 46 can also be shortened. Therefore, the smelting apparatus can be made compact, resulting in a substantial reduction of the installation area. Furthermore, since the number of burners to be attached is decreased and the structure of the launders is simple, the running costs as well as the labor required to keep the launders in a hermetically sealed state will be reduced. In the foregoing, the spacing between the adjacent anode furnaces may appear to be small, but is sufficient for the operators to carry out necessary operations such as work on tuyeres, or receiving and discharging work beside the anode furnaces.

Obviously, many modifications and variations of the present invention are possible in the light of the above teachings. It is therefore to be understood that within the scope of the appended claims, the invention may be practiced otherwise than as specifically described.

What is claimed is:

1. A copper smelting apparatus comprising:

a matte-producing means for producing matte;

a converting furnace for oxidizing said matte produced in said matte-producing means into blister copper;

a plurality of blister copper refining furnaces for refining the blister copper produced in said converting furnace into copper of higher purity; and blister copper launder means for connecting said converting furnace and said blister copper refining furnaces to transfer blister copper from said converting furnace to one of said blister copper refining furnaces.

2. The apparatus as recited in claim 1, wherein said blister copper launder means includes a main launder having one end connected to said blister copper-producing means and a plurality of branch launders each having one end connected to the other end of said main launder and the other end connected to a respective one of said blister copper refining furnaces.

3. The apparatus as recited in claim 2, further comprising a selecting device attached to said blister copper launder means for selectively bringing said main launder into fluid communication with one of said branch launders.

4. The apparatus as recited in claim 1, wherein said blister copper refining furnaces include a furnace body having a shell portion and a pair of end plates mounted on opposite ends thereof, said furnace body being supported rotatably about an axis thereof with said axis being arranged horizontally, said shell portion of said furnace body having a circumferentially extending opening for receiving the blister copper; and wherein said blister copper launder means includes an end portion disposed at said opening of said furnace body.

5. The apparatus as recited in claim 4, wherein said blister copper refining furnaces further include an exhaust duct formed so as to provide a hood over said opening of said furnace body in relation to a prescribed rotational range of said furnace body, whereby exhaust gas is exhausted through said opening.

6. The apparatus as recited in claim 5, wherein said end portion of said blister copper launder means located above said opening of said furnace body is provided with a water-cooling jacket.

7. The apparatus as recited in claim 3, wherein said plurality of blister copper refining furnaces are disposed parallel to one another with one end of each blister copper refining furnace being directed toward said converting furnace while the shell portions of adjacent blister copper refining furnaces are opposed to each other.

* * * * *

US005380353C1

(12) EX PARTE REEXAMINATION CERTIFICATE (5003rd)

United States Patent
Goto et al.

(10) Number: US 5,380,353 C1
(45) Certificate Issued: Oct. 26, 2004

(54) COPPER SMELTING APPARATUS

(75) Inventors: Moto Goto, Tokyo (JP); Nobuo Kikumoto, Tokyo (JP); Osamu Iida, Tokyo (JP); Hiroaki Ikoma, Osaka (JP); Shigemitsu Fukushima, Tokyo (JP)

(73) Assignee: Mitsubishi Materials Corporation, Tokyo (JP)

Reexamination Request:
No. 90/004,783, Oct. 3, 1997

Reexamination Certificate for:

| | |
|---|---|
| Patent No.: | **5,380,353** |
| Issued: | **Jan. 10, 1995** |
| Appl. No.: | **08/040,999** |
| Filed: | **Mar. 31, 1993** |

( * ) Notice: This patent is subject to a terminal disclaimer.

Related U.S. Application Data

(63) Continuation-in-part of application No. 07/797,116, filed on Nov. 20, 1991, now Pat. No. 5,205,859.

(30) Foreign Application Priority Data

| | | |
|---|---|---|
| Nov. 20, 1990 | (JP) | 2-314671 |
| Nov. 20, 1990 | (JP) | 2-314673 |
| Nov. 20, 1990 | (JP) | 2-314675 |
| Nov. 20, 1990 | (JP) | 2-314682 |

(51) Int. Cl.[7] ..... C22B 15/06
(52) U.S. Cl. ..... 75/640; 75/641; 75/643; 266/162
(58) Field of Search ..... 266/161, 162, 266/213, 215, 218, 163, 173, 196, 195; 75/645, 646, 638

(56) References Cited

U.S. PATENT DOCUMENTS

| | | | | |
|---|---|---|---|---|
| 1,198,434 A | * | 9/1916 | Garred | 75/650 |
| 3,650,519 A | * | 3/1972 | Vogt et al. | 266/215 |
| 3,715,203 A | | 2/1973 | De Bic | 75/76 |
| 4,178,174 A | * | 12/1979 | Arentzen | 75/429 |
| 4,238,228 A | * | 12/1980 | Brimacombe et al. | 75/629 |
| 4,245,821 A | | 1/1981 | Kappell et al. | |
| 4,390,169 A | * | 6/1983 | LaBate | 266/196 |
| 4,421,552 A | | 12/1983 | Hoffmann et al. | 79/9 |
| 4,451,291 A | * | 5/1984 | Leiponen | 75/162 |
| 4,504,309 A | * | 3/1985 | Mackey et al. | 75/627 |
| 5,398,915 A | * | 3/1995 | Goto et al. | 266/213 |

FOREIGN PATENT DOCUMENTS

| | | | |
|---|---|---|---|
| CA | 1190751 | * | 7/1985 |
| GB | 16273 | | of 1892 |
| GB | 2 141 535 | | 12/1984 |
| GB | 2141535 | * | 12/1984 |
| JP | 51-43447 | | 11/1976 |
| JP | 55-5574 | | 2/1980 |
| JP | 55-33597 | | 3/1980 |

(List continued on next page.)

OTHER PUBLICATIONS

Oxygen Smelting and the Olympic Dam Project, T.J.A. Smith, I. Posener and C.J. Williams, pp. 49–59, The Impact of Oxygen on the Productivity of Non–ferrous Metallurgical Processes, Winnipeg, Canada, Aug. 23–26, 1987, vol. 2 Proceedings of the Metallurgical Society of the Canadian Institute of Mining and Metallurgy.

(List continued on next page.)

*Primary Examiner*—Scott Kastler

(57) ABSTRACT

There is disclosed an apparatus for smelting copper which includes a blister copper-producing device. A plurality of anode furnaces are provided for refining the blister copper produced in the blister copper-producing device into copper of higher quality. A blister copper launder assembly, which has a main launder and a plurality of branch launders branched off from the main launder, is provided to connect the converting furnace and the anode furnaces together. A selecting device may be attached to the launder assembly for selectively bringing the main launder into fluid communication with one of the branch launders.

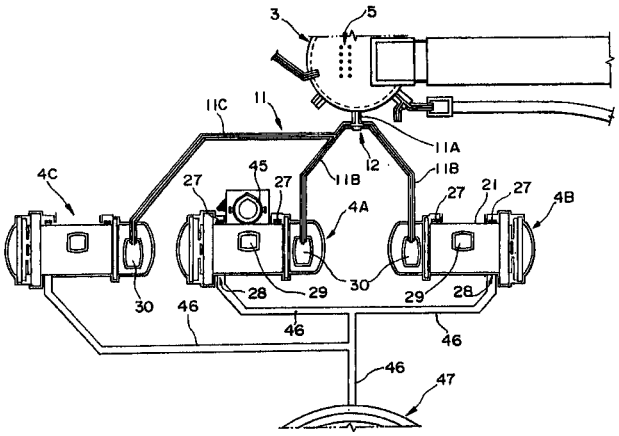

FOREIGN PATENT DOCUMENTS

| | | | |
|---|---|---|---|
| JP | 57-210930 | | 12/1982 |
| JP | 56-15649 | | 1/1983 |
| JP | 59-110716 | | 6/1984 |
| JP | 61-52327 | * | 3/1986 |
| JP | 63-247309 | | 10/1988 |
| JP | 63-265802 | | 11/1988 |
| JP | 1-294832 | | 11/1989 |
| JP | 2-63544 | | 3/1990 |

OTHER PUBLICATIONS

Pyrometallurgy of Copper, L.M. Gazarian, 2nd revised and supplemented edition, Metallurgia, Moscow Dec. 1965, pp. 204–208.

Preparation of Anodes: Sulphur and Oxygen Removal, Chapter 12, pp. 242–245 Extractive Metallurgy of Copper, A.K. Biswas, University of Queensland, Brisbane, Australia and W.G. Davenport, McGill University of Quebec, Canada.

TMS Technical Paper, Review of Flash Smelting and flash Converting Technology, Paper No. A86–64, Dale W. Rodolff, Yrjo E. Anjala and Pekka T. Hanniala, The Metallurgical Society of AIME, 420 Commonwealth Drive, Warrendale, PA 15086, 3/86.

The Role of Oxygen in the Outokumpu Flash Smelting Process, Y. Astelijoki and P. Hanniala, pp. 87–105. The Impact of Oxygen on the Productivity of Non–Ferrous Metallurgical Processes, Winnipeg, Canada, Aug. 23–26, 1987, vol. 2 Proceedings of the Metallurgical Society of the Canadian Institute of Mining and Metallurgy, 1987.

Outokumpu Flash Smelting in Copper Metallurgy—The Latest Developments and Applications, Yrjo Anjala, Jussi Asteljoki and Pekka Hanniala, pp. 19–35, Copper 87, vol. 4, Pyrometallurgy of Copper.

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *